US005601359A

United States Patent [19]

Sharrah et al.

[11] Patent Number: 5,601,359

[45] Date of Patent: Feb. 11, 1997

[54] FLASHLIGHT HAVING RESILIENT SLEEVE

[75] Inventors: Raymond L. Sharrah, Collegeville; John DiNenna, Bridgeport; David A. Rufe, Schwenksville, all of Pa.

[73] Assignee: Streamlight, Inc., Norristown, Pa.

[21] Appl. No.: 450,736

[22] Filed: May 25, 1995

[51] Int. Cl.[6] ..... F21L 7/00

[52] U.S. Cl. ..... 362/204; 362/188; 362/189; 362/206; 362/207

[58] Field of Search ..... 362/158, 189, 362/204, 206, 207, 188

[56] References Cited

U.S. PATENT DOCUMENTS

| | | | |
|---|---|---|---|
| 2,143,558 | 1/1939 | Joers | 362/189 |
| 2,234,972 | 3/1941 | Lennan | 362/189 |
| 2.235,714 | 3/1941 | Lennan | 362/189 |
| 2,299,035 | 10/1942 | Rothenberg et al. | D26/49 |
| 4,800,472 | 1/1989 | Burton et al. | 362/158 |

*Primary Examiner*—Ira S. Lazarus
*Assistant Examiner*—Alfred Basichas
*Attorney, Agent, or Firm*—Dann, Dorfmann, Herrell and Skillman, P.C.

[57] ABSTRACT

A flashlight is provided with a conductive casing and a resilient sleeve positioned on the conductive casing. The sleeve is mounted on the casing by conducting a flow of pressurized gas through the casing, aligning the sleeve with the rear end of the casing to inflate the sleeve, and then urging the sleeve onto the casing. The sleeve is configured to expose the forward end of the casing, which is threaded to rotatably engage a head assembly. The head assembly includes a spring positioned therein for mounting a conductive rim of a lamp socket in abutment with the forward end of the casing.

23 Claims, 4 Drawing Sheets

FLASHLIGHT HAVING RESILIENT SLEEVE

FIELD OF THE INVENTION

The present invention relates to a flashlight. In particular, the present invention relates to a machined metal flashlight having an elastomeric gripping surface.

BACKGROUND OF THE INVENTION

Flashlights for use by law enforcement officers and by others requiring a high-performance flashlight, are commonly provided with a machined aluminum housing. Machined aluminum flashlights possess several advantages relative to the commercial variety of plastic flashlights. For example, machined aluminum flashlights are less subject to impact damage relative to plastic flashlights, which is particularly important for flashlights having screw-threaded mating parts. Additionally, an aluminum housing provides effective heat dissipation from the lamp, which allows higher wattage bulbs to be operated at relatively greater efficiency and brightness. Aluminum is also highly electrically conductive, hence there is less resistive power loss when an aluminum casing is employed as a part of the lamp circuit, relative to other metals.

In the manufacture of machined aluminum flashlights, considerable effort must be expended in order to produce an appealing high-luster anodized finish for the outside of the flashlight. Prior to applying such anodized finish, the barrel of the flashlight is often textured to provide a gripping surface, for example a diamond knurled surface may be provided along the outside of the flashlight. Inconsistencies in the finishing process can result in having to discard expensive precision parts due to cosmetic flaws. Additionally, when mating surfaces of finished aluminum parts are intended to provide an electrically conductive path within the flashlight, it is necessary to remove the finish from the mating surfaces prior to assembling the flashlight. Such removal of the finish from portions of the flashlight must be done with great care and precision to avoid damaging the other portions of the finished parts. Damage to the finished parts due to errors during selective removal of the finish, again results in having to discard parts for cosmetic reasons. Accordingly, it would be desirable to develop an aluminum flashlight that could be provided with an attractive exterior surface in such a way as to reduce the number of aluminum parts that are customarily discarded to maintain cosmetic quality control.

Although machined aluminum flashlights are usually provided with textured gripping surfaces, such flashlights can be uncomfortable to grip under some conditions. For example, perspiration or other moisture can loosen one's grip on the metal barrel of the flashlight. Additionally, the heat conductivity of the aluminum, which is beneficial for cooling the lamp, can cause the flashlight to feel cold and can draw heat from the user's hand during use in cold conditions. Hence, it would be desirable to provide a flashlight having the mechanical and operational advantages of a machined aluminum flashlight, while also having a secure and comfortable gripping surface. It would also be desirable to provide such a flashlight at a reduced cost in the number of machining operations required.

SUMMARY OF THE INVENTION

In accordance with one aspect of the present invention, an aluminum flashlight is provided with an elastomeric sleeve for providing an attractive, comfortable gripping surface.

The barrel of the flashlight comprises an unfinished aluminum tube having a threaded forward end protruding from the elastomeric sleeve. A head assembly for housing a lamp and socket assembly is provided with a threaded bore for engaging the forward end of the tube. The forward end of the sleeve includes an integral sealing portion for providing a compressive seal between the tube and an overlapping rim extending rearwardly from the head.

According to another aspect of the invention, a method for assembling an elastomeric-encased aluminum flashlight barrel is provided. In this aspect of the invention a switch assembly is adapted to be positioned within the rear of an aluminum tube. With the switch assembly in position, there is provided a fluid passageway between the switch assembly and the inner surface of the tube. The fluid passageway allows a flow of compressed gas to be conducted through the tube after the switch assembly has been fixed in position in the tube. In this arrangement, the elastomeric sleeve is aligned with the rear of the tube and is inflated by the flow of compressed gas through the tube. The inflated sleeve is urged around and over the tube in the forward direction. After the sleeve has been fully positioned on the tube, the flow of gas is discontinued, and the sleeve deflates to compressively engage the tube.

Other new and useful aspects of the invention will become apparent in the description of the invention.

BRIEF DESCRIPTION OF THE DRAWINGS

The foregoing summary, as well as the following detailed description of the preferred embodiments of the present invention, will be better understood when read in conjunction with the appended drawings, in which.

DETAILED DESCRIPTION OF THE PREFERRED EMBODIMENTS

Figure 1:
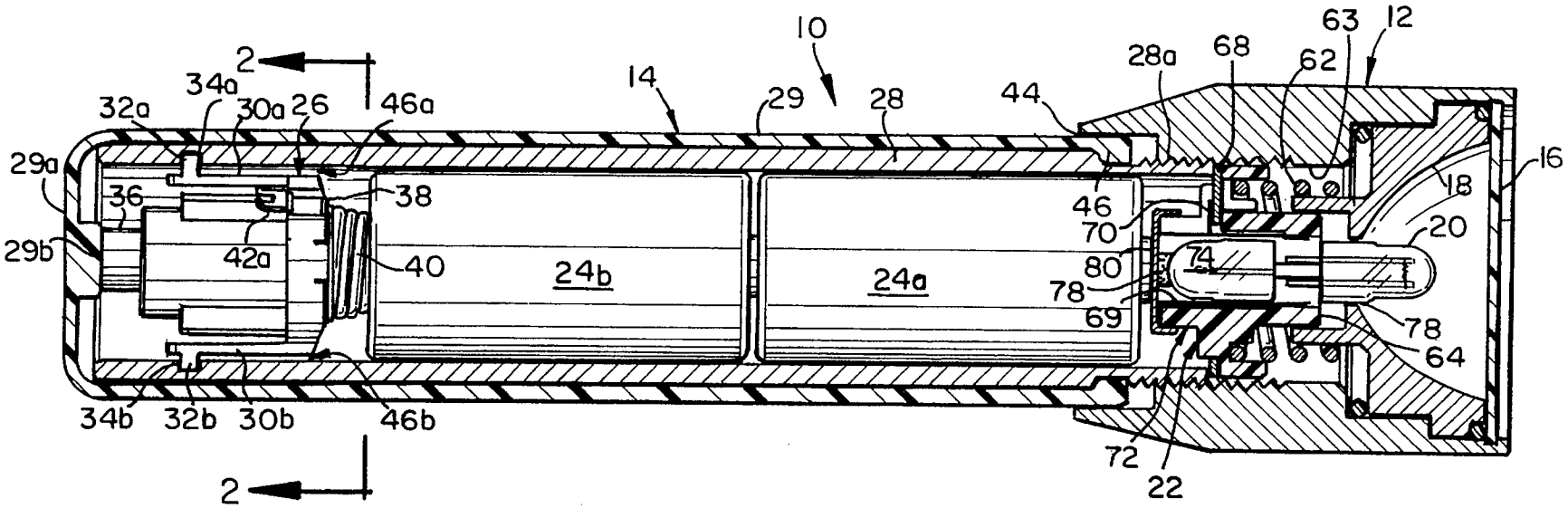
FIG. 1 is a sectional view of a flashlight of the present invention.

Referring now to FIG. 1, there is shown a flashlight generally designated 10. The flashlight 10 includes an enlarged head 12 and a tubular barrel 14. The enlarged head 12 is threaded on the forward end of the barrel 14. The enlarged head 12 provides a housing for lens 16, reflector 18, bi-pin lamp 20 and lamp socket assembly 22. The barrel 14 provides a central housing for series-connected batteries **24*a* and 24*b* and switch assembly 26**.

The barrel 14 includes an inner aluminum casing or tube 28. The casing 28 is sized to receive and hold a pair of batteries **24*a* and 24*b*. The batteries 24*a* and 24*b*** are preferably alkali-metal oxide batteries, such as 3 volt lithium-manganese dioxide ($Li\text{-}MnO_2$) batteries. Such batteries provide exceptional energy density, discharge rate, and capacity retention.

The forward end of the aluminum casing 28 is threaded around the end 28*a* for receiving mating threads on the inside of the head 12. The rear end 28*b* of casing 28 is open to permit access to the switch assembly 26 during assembly of the flashlight. Casing 28 is positioned concentrically within an elastomeric sleeve 29. The sleeve 29 is closed at the rear end thereof for sealing the rear end of the barrel 14. The forward, threaded end of casing 28 protrudes beyond the forward end of the sleeve 29 for mating engagement with the head 12. The forward end of sleeve 29 terminates in an integrally-formed, annular sealing ring or element 46 for sealing the junction between the casing or barrel 14 and the head 12 to prevent moisture or dust from passing therebetween. The head 12 has a rearward overlapping rim 44, which compresses the sealing ring 46 between the rim 44 and the casing 28 when the flashlight is assembled.

Switch assembly 26, preferably of the push button type, is positioned within the rear portion of casing 28. The switch assembly 26 includes flexible, cantilevered support members 30*a* and 30*b* connected to the forward end of the switch assembly 26. The support members 30*a* and 30*b* extend rearward within the casing 28 along opposite sides of the switch assembly to provide a latch mechanism to hold the switch assembly fixed in the rear end of the casing. Radially outward extending tabs 32*a* and 32*b* are formed along the respective support members 30*a* and 30*b* to extend radially outwardly for compressive engagement within complementary slots 34*a* and 34*b* formed on opposite sides in the interior surface of casing 28 near the rear end thereof. The engagement of tabs 32*a* and 32*b* within slots 34*a* and 34*b* maintains the switch assembly 26 in stationary central alignment within the rear end of casing 28. The switch is operable by pushing on the sleeve 29 enclosing the rear or tail end of the casing.

Figure 2:
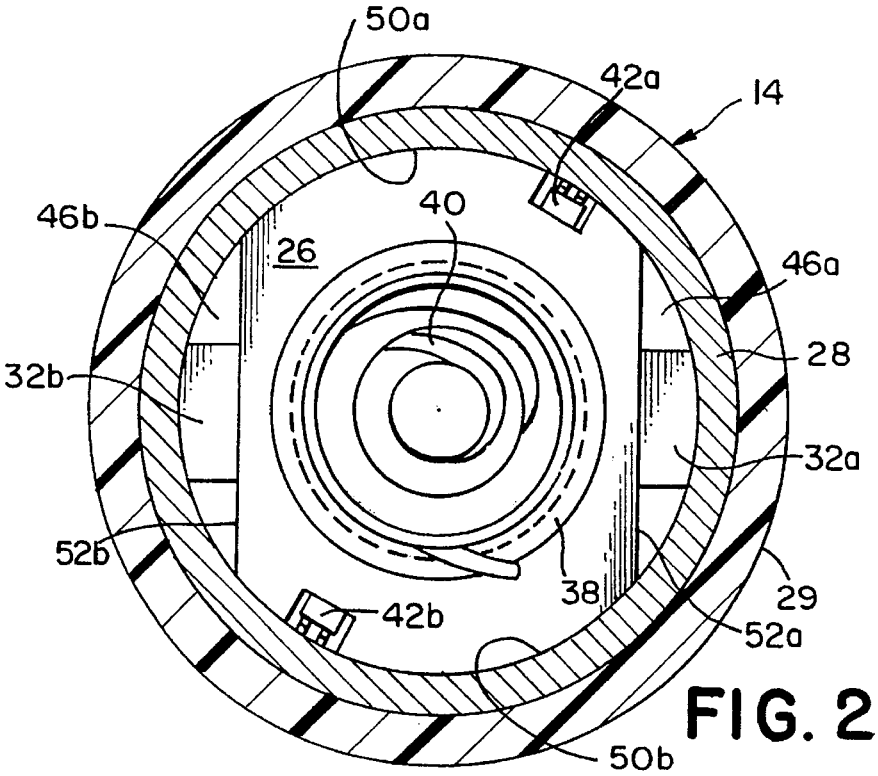
FIG. 2 is a rear sectional view of the flashlight taken along the line 2—2 of FIG. 1.
Figure 3:
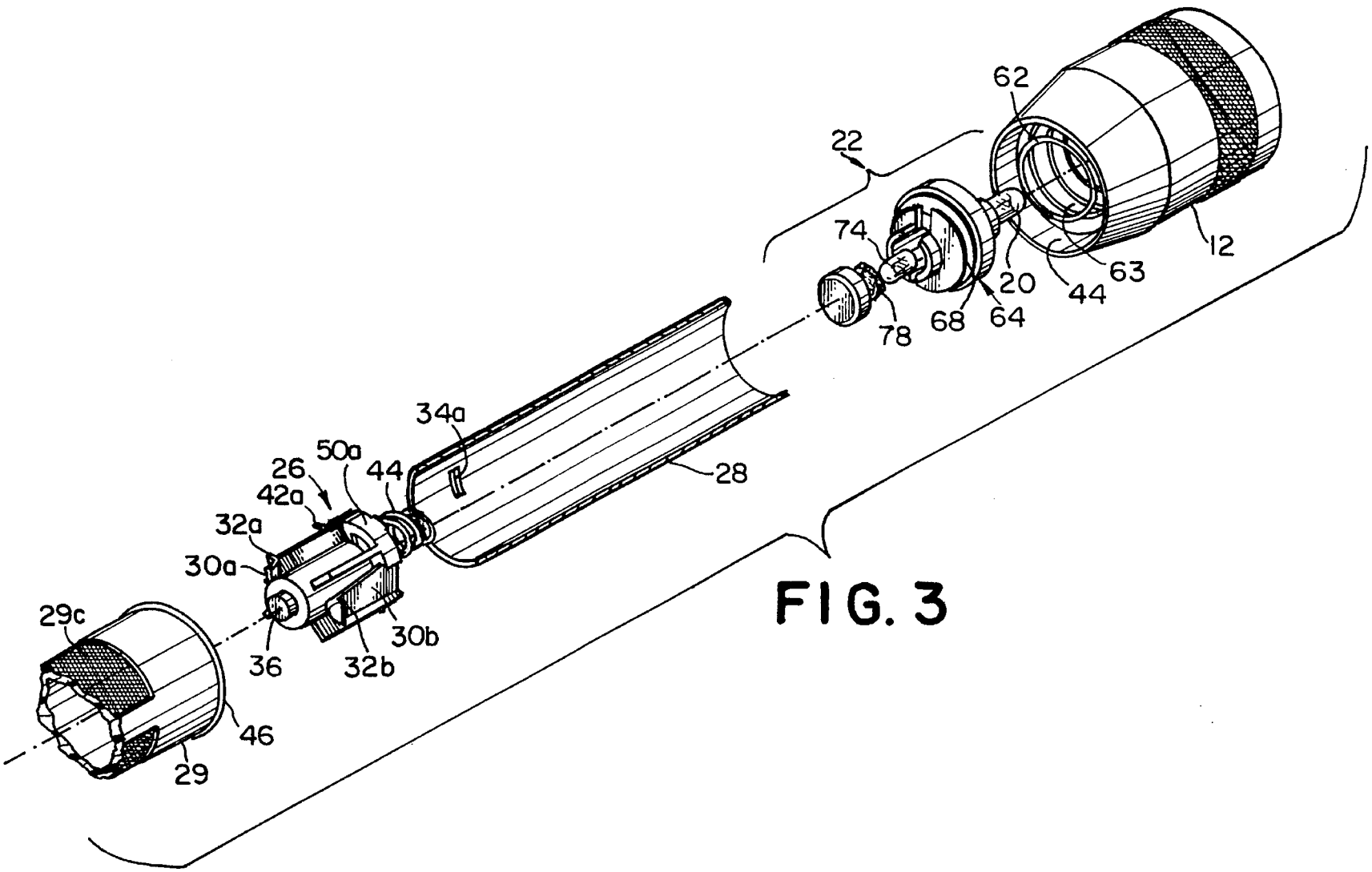
FIG. 3 is an exploded perspective view of the flashlight with the barrel cut away, the batteries removed and the back end of the elastomeric sleeve is omitted.

As best shown in FIGS. 2 and 3, the switch assembly 26 has curved peripheral surfaces 50*a* and 50*b* about the forward end thereof for conforming with the curved interior surface of casing 28 for promoting alignment of switch assembly 26 in the casing. The curved surfaces 50*a* and 50*b* extend a distance around opposed peripheral surfaces of the forward portion of the switch assembly 26. The curved surfaces 50*a* and 50*b* are foreshortened by flat surfaces 52*a* and 52*b* on opposite sides of the switch assembly, so that air passages designated 46*a* and 46*b* are formed between the sides of switch assembly 26 and the casing 28, when the switch assembly 26 is positioned within casing 28. The air passages 46*a* and 46*b* permit a flow of compressed air to be conducted through the casing 28 during assembly of the sleeve 29 on the casing 28, the air facilitating placement of the sleeve 29 over the casing 28, as described hereinbelow.

A spring retainer 38 is attached to the forward end of switch assembly 26 for retaining one end of spring 40. Spring 40 extends from the switch assembly 26 toward the battery compartment in the casing. The spring 40 is compressed between the forward end of switch assembly 26 and the rear terminal, preferably the negative terminal, of battery 24*b*. The spring 40 functions to electrically connect the negative terminal of battery 24*b* to the switch assembly 26 and to urge the batteries 24*a* and 24*b* toward the front end of the casing 28.

A contact member 42*a* is provided on the outside of the switch assembly and extends radially outward from one side of switch assembly 26 for establishing contact with the interior of the metal casing 28. A similar contact member 42*b* extends radially outward from the opposite side of switch assembly 26 to contact the other side of the metal casing. The contact members 42*a* and 42*b* are preferably flexible copper tabs that are electrically interconnected within the switch assembly 26. A push button 36 protrudes from the rear of the push button switch assembly 26. The button 36 is positioned to be flush with, or recessed slightly within the rear end of the casing 28. The rear end 29*a* of sleeve 29 has an internal protrusion or boss 29*b* formed therein and aligned with the rear surface of push button 36. The rear end 29*a* of sleeve 29 is adapted to be sufficiently resilient to be deformed in response to pressure applied to the sleeve at the rear of the flashlight for urging protrusion 29*b* against button 36 for activating the switch assembly to turn the flashlight "on" and "off". When the button 36 is activated to turn the flashlight "on" an electrical connection is established within the switch assembly 26 between the spring 40 and the contacts 42*a* and 42*b*, thus connecting the casing 28 with the negative terminal of battery 24*b*.

Figure 4:
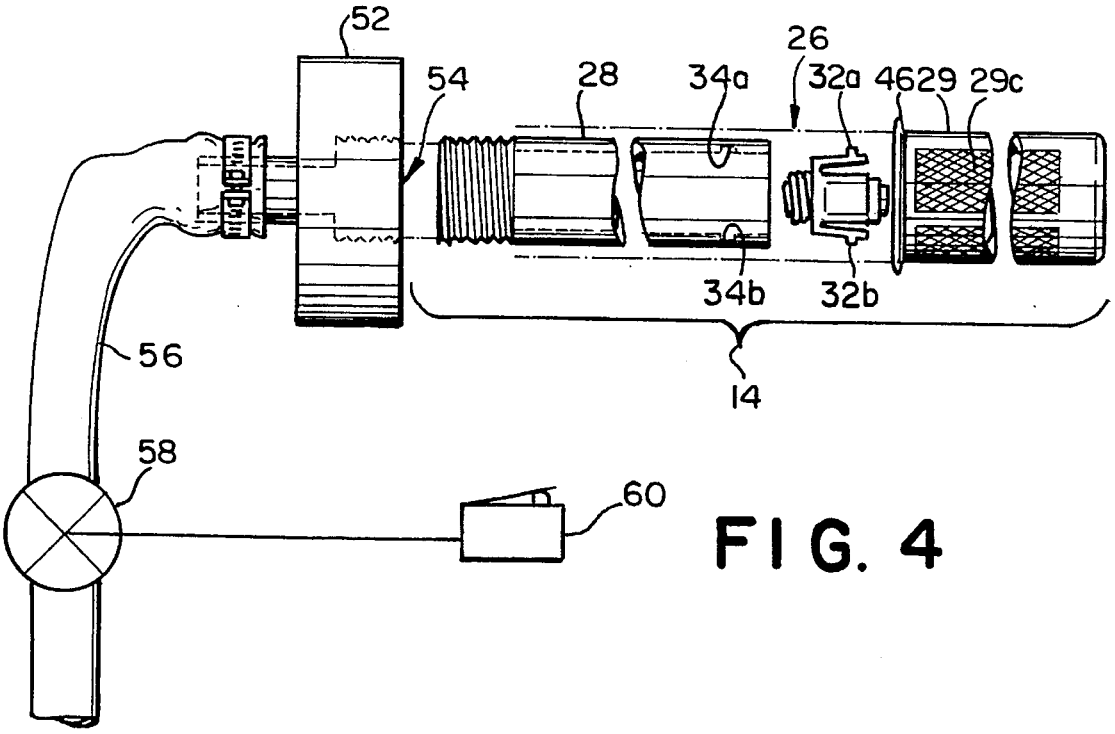
FIG. 4 is a schematic view of an apparatus and procedure for assembling the switch barrel and elastomeric sleeve of the flashlight of FIG. 1.

The preferred method for assembling the barrel 14 is illustrated in FIG. 4. The casing 28 is initially provided as a length of tubular aluminum stock. Male threads are formed in the forward end of the casing 28. Then, switch assembly 26 is inserted into the casing 28 and aligned therein for having engaging tabs 32*a* and 32*b* engaged within the mating slots 34*a* and 34*b*, respectively to latch the switch in position.

After the switch assembly 26 has been positioned and fixed within the casing 28, the forward end of the tube 28 is coupled to an assembly fixture 52. The assembly fixture 52 preferably has a female threaded bore 54 for receiving and mating with the threaded end of casing 28. The bore 54 in fixture 52 is in fluid communication with and coupled to a compressed air supply line 56. The compressed air supply line 56 is connected with a source of compressed air (not shown), e.g. a compressed air tank or compressor, for supplying a flow of compressed air, or other gas, to the assembly fixture 52.

Fluid control means, such as valve 58 along line 56, is provided for allowing an assembly operator to control the flow of compressed air to the assembly fixture 52. For example, the fixture 52 may be mounted to a table (not shown), and a foot switch generally designated and shown at 60 may be provided in operative connection with valve 58 for allowing the operator to selectively activate and deactivate the flow of compressed air to the fixture 52. Alternatively, the operator may be provided with electrical means for turning a compressor (not shown) "on" or "off".

As shall be appreciated, the formation of one or more air passages adjacent to the switch assembly 26, as discussed above for air passages 46*a* and 46*b*, permits air to flow from the supply line 56, through bore 54, and then through the casing 28. When such a flow has been established, the assembly operator aligns the forward end of the sleeve 29 with the rear end of tube 28, as indicated in FIG. 4. Then the operator slides the sleeve 29 onto the tube 28. The flow of compressed air through the casing 28 is maintained while the sleeve 29 is positioned over the casing 28. The compressed air flow inflates the sleeve, or radially provides a cushion of air between the casing and the sleeve 29, to decrease friction between the interior of the sleeve and the exterior of the casing 28. After the sleeve has been fully slid onto the casing 28, such that the rear end of the tube 28 abuts the interior rear surface of the sleeve 29, the flow of compressed air is turned "off".

It should be apparent that the use of compressed air to inflate the sleeve 29 during assembly of the barrel 14 allows the sleeve 29 to be initially formed having an inner diameter that is about equal to, or less than, the outer diameter of the casing 28. In this arrangement there is a secure compressive engagement maintained between the sleeve 29 and the casing subsequent to assembly.

For enhanced ease of assembly, the interior of the sleeve and/or the exterior of the casing 28, may be coated with a thin film of lubricant prior to sliding the sleeve onto the casing. Preferably, the lubricant is of a type that subsequently dries or hardens to provide an adhesive layer between the sleeve and the casing so that a secure engagement is provided therebetween. For example, a soap solution may be used to provide such a lubricant, as the soap dries after the lubrication assembly to provide an adhesive layer between the sleeve and casing.

After the flow of compressed air is turned off, the operator may inspect the assembled barrel for the presence of any air bubbles that may be trapped between the sleeve and the tube. Any such air bubbles may then be removed by manually applying pressure to the barrel and pushing the bubbles between the sleeve 29 and casing 28 toward the forward end of the barrel. The assembled barrel is then removed from the assembly fixture 52 for attaching the head assembly to the barrel.

In the preferred embodiment of the invention, the exterior of the sleeve 29 has a molded gripping surface 29*c* formed therein as shown in FIG. 3, for providing a comfortable, secure grip by the user. The sleeve 29 is preferably formed of a resilient, thermally-insulating elastomer, such as "ALCRYN" elastomer, manufactured by DuPont of Wilmington, Del. Since the sleeve 29 provides the exterior surface of the barrel 14, the exterior surface of the aluminum casing 28 may remain in an unfinished condition, and need not be discarded because of cosmetic flaws. Additionally, there is no need to protect the unthreaded portion of the casing from incidental cosmetic damage when the threaded end is machined. Thus, the cost of maintaining cosmetic quality control for the exterior of the aluminum casing is eliminated, providing a great cost saving relative to the expense of manufacture of traditional machined aluminum flashlights.

Referring now to FIG. 3, the assembly of the head of the flashlight proceeds by positioning the socket assembly generally designated 22 within the head 12. An axial bore 63 is provided in the generally cylindrical head 12 for receiving the socket assembly. The rear portion of the bore 63 is threaded for connection with the threaded forward end of casing 28.

The socket assembly 22 includes a socket member 64 for holding the bi-pin lamp 20 and for making positive and negative electrical connections to the lamp 20. The socket member 64 is preferably molded from a heat-resistant material, such as "VALOX 420" glass-filled polyester resin, manufactured by General Electric. A concentric axially-aligned spring 62 encircles the forward portion of the socket member in the head assembly and engages a circular groove formed in an increased diameter portion toward the rear end of the socket member 64. The diameter of the socket member 64 is larger than the inner diameter of casing 28, so that the spring 62 urges the rear rim 64*a* of the socket member 64 against the forward end of the casing 28 when the flashlight is assembled. An annular conductor 68 is positioned on and attached to the rearward facing rim of the socket member 64 for contacting the forward end of the casing 28 for providing electrical contact therebetween.

Figure 5:
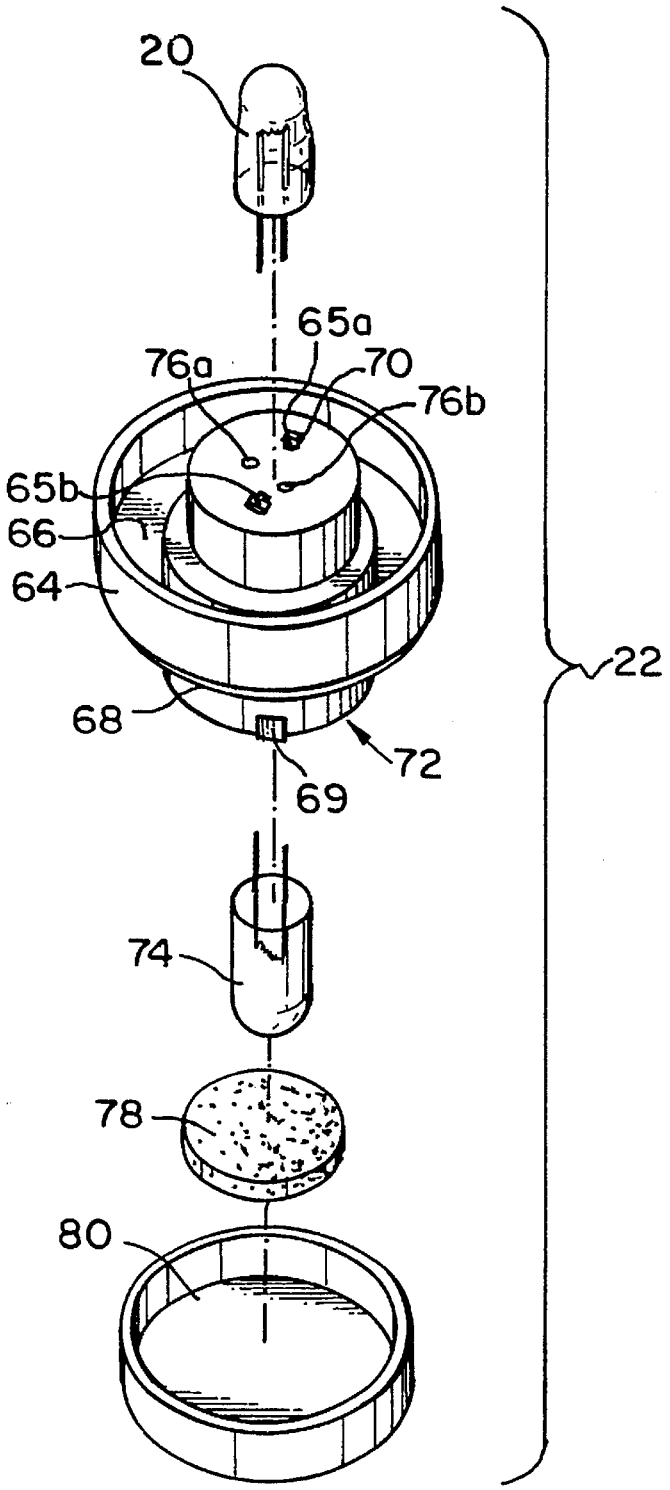
FIG. 5 is an exploded perspective view of the lamp and socket assembly of the flashlight of FIG. 1.

The socket assembly 22 is shown in greater detail in FIG. 5. The annular conductor 68 is electrically connected, within socket member 64, to a conductive strip 70, shown in FIG. 1. The conductive strip 70 extends within the socket member 64 from a connection with annular conductor 68 to socket aperture 65*a* shown in FIG. 5, which receives one of the pins of lamp 20. Thus, referring again to FIG. 1, the negative side of the lamp circuit is established from the negative terminal of battery 24*b*, through spring 40 to the switch assembly 26, from the conductors 42*a* and 42*b* of the switch assembly 26 to the casing 28, from casing 28 to the annular conductor 68, and from the annular conductor 68 through the conductive strip 70 to one of the pins of the lamp 20.

A cylindrical boss 72 extends rearwardly from the socket member 64 into the casing 28 and provides a housing for containing a spare lamp 74 therein. The spare lamp 74 is inserted into the boss at the rear of the socket member 64, such that the pins of lamp 74 are received in holes 76*a* and 76*b* formed within the socket member 64, as should be appreciated from FIGS. 1 and 5. The holes 76*a* and 76*b* preserve the alignment and spacing of the pins of lamp 74 during storage within the boss 72. In order to secure and protect the spare lamp 74 within the socket member 64, a foam member 78 is placed over the end of the boss 72. Preferably, a conductive cap 80 is frictionally attached to the socket member 64 to cover the rear of the boss 72. Conductive cap 80 provides contact with the forward terminal of battery 24*a*. A conductive strip 69 overlaps the rear rim of the boss 72 and extends within the socket member 64 for connecting the cap 80 with the other pin of lamp 20.

Referring again to FIG. 1, the positive terminal of battery 24*a* is maintained in contact with the cap 80 by the compressive force exerted by spring 40 against the rear of battery 24*b*. Hence, the positive side of the lamp circuit is established from the positive terminal of battery 24*a*, through the conductive cap 80, and through conductive strip 69 to the other pin of the lamp.

The lamp 20 is preferably a high-pressure bi-pin lamp containing a halogen gas, such as xenon. In order to adequately cool the lamp during operation of the flashlight, the reflector 18, which encircles the lamp 20, is formed of a highly heat-conductive metal, such as aluminum. The reflector 18 is contoured to be tightly pressed into head 12, for efficient heat transfer from the reflector 18 to the head 12. The lamp 20 is positioned to extend through a central aperture 78 within the reflector 18. The forward surface of the reflector 18 forms a parabola for directing light from the lamp 20 in the forward direction. The position of lamp 20 relative to the focal point of the parabola, and hence the divergence angle of the light projected from the flashlight, can be varied by rotating the head 12 relative to the barrel 14 about the central axis of the flashlight. Such rotation causes the head 12 to move upon the threaded end of casing 28 in the forward or rearward directions, depending upon the direction of rotation. Accordingly, the reflector 18 within head 12 will also move with the head 12. The force exerted by spring 62 against the lamp socket assembly 22 is sufficient to maintain the lamp socket assembly 22 in abutment with the forward end of the casing 28 as the head 12 is moved along the axis of the flashlight. Hence, the lamp 20 remains stationary, while the reflector 18 is translated axially in order to alter the focus of the flashlight. Of course, when the head 12 is completely unscrewed from the front of the barrel 14, the head 12 and the lamp socket 22 may be removed from the barrel, e.g. for replacement of the batteries 24*a* and 24*b*.

It should be appreciated by those skilled in the art that the terms and expressions, which have been employed, are used as terms of description and not of limitation. There is no intention in the use of such terms and expressions of excluding any equivalents of the features and structure shown and described or portions thereof. It is recognized, however, that various modifications are possible within the scope and spirit of the invention as claimed.

That which is claimed is:

1. A method for assembling a flashlight barrel having a forward end and a rear end, comprising:

providing a metal casing having a generally tubular form for holding at least one battery;

positioning a switch assembly within the casing such that a fluid passage is provided between the switch assembly and the casing;

coupling the forward end of the metal casing with a flow of compressed gas such that the flow of gas passes through the tube and out of the rear end;

aligning a resilient sleeve with the rear end of the casing such that the sleeve is at least partially inflated by the flow of gas; and sliding the resilient sleeve toward the forward end of the casing.

2. The flashlight barrel produced in accordance with the method of claim 1.

3. A flashlight having a forward end and a rear end, comprising:

a conductive casing adapted to enclose at least one battery, the casing being generally tubular with open ends, and having first engaging means formed in an interior surface thereof;

a resilient sleeve positioned on the casing, the sleeve having an open end for exposing the forward end of the casing, and a rear portion for enclosing the rear end of the casing;

a switch assembly positioned in the rear portion of the casing, the switch assembly having second engaging means for mating engagement with the first engaging means of the casing; the switch assembly being electrically connected with the casing;

first spring means positioned within the casing between the battery and the switch assembly for urging the battery toward the forward end of the flashlight, the switch assembly having an actuating member extending toward the rear end of the casing, the actuating member being adapted to complete a circuit between the spring means and the casing;

a lamp;

a lamp socket for holding the lamp, the lamp socket having a conductive portion contacting the casing and a contact member contacting the forward end of at least one battery, the socket having means for connecting the lamp with the conductive portion and the contact member; and a head for the flashlight adapted to receive the lamp socket, the head being rotatably held by the forward end of the casing for changing the light pattern from flashlight.

4. The flashlight of claim 3 wherein said resilient sleeve includes an integral sealing member formed about the open end and said head includes a rearward extending rim for compressing said sealing member against the casing.

5. The flashlight of claim 3 wherein said lamp socket includes an axially extending portion having a compartment therein for storing a spare lamp, and wherein said contact member comprises a conductive cap forming the rear of the compartment and contacting the battery.

6. The flashlight of claim 5 wherein the lamp and the spare lamp each comprise a bi-pin lamp, and wherein the lamp socket includes a rearward facing surface within the forward end of the axially extending portion for receiving the pins of the spare lamp.

7. The flashlight of claim 6 wherein the lamp and the spare lamp are held in central axial alignment with the casing.

8. The flashlight of claim 3 wherein the forward end of the casing has a threaded portion and wherein the head includes a threaded bore for mating with the threaded portion of the casing.

9. The flashlight of claim 8 wherein the casing consists essentially of an unfinished aluminum tube having a threaded forward end.

10. The flashlight of claim 3 in which the sleeve has a movable actuator portion extending into the rear end of the casing for activating contact with the activating member of the switch assembly.

11. The flashlight of claim 3 wherein the conductive portion of the socket comprises a rim in abutment with the forward end of the casing.

12. The flashlight of claim 11 wherein the head comprises second spring means positioned therein for urging the rim against the forward end of the casing and for maintaining the rim in abutment with the forward end of the casing as the head is rotated.

13. A flashlight having a forward end and a rear end, comprising:

a conductive casing adapted to enclose at least one battery, the casing being generally tubular with open ends, and having first engaging means formed in an interior surface thereof;

a resilient sleeve positioned on the casing, the sleeve having an open end for exposing the forward end of the casing, and a rear portion for enclosing the rear end of the casing;

a switch assembly positioned in the rear portion of the casing, the switch assembly having second engaging means for mating engagement with the first engaging means of the casing, the switch assembly being electrically connected with the casing;

first spring means positioned within the casing between the battery and the switch assembly for urging the battery toward the forward end of the flashlight, the switch assembly having an actuating member extending toward the rear end of the casing, the actuating member being adapted to complete a circuit between the spring means and the casing;

a lamp;

a lamp socket for holding the lamp, the lamp socket having a conductive portion contacting the casing and a contact member contacting the forward end of at least one battery, the socket having means for connecting the lamp with the conductive portion and the contact member;

a head for the flashlight adapted to receive the lamp socket, the head being rotatably held by the forward end of the casing for changing the light pattern from flashlight; and second spring means positioned within the head for urging the lamp socket toward the casing for maintaining the conductive portion of the socket in contact with the casing when the head is rotated relative to the casing for changing the light patterns.

14. The flashlight of claim 13 comprising a reflector positioned within said head, the reflector having an aperture for receiving the lamp therein, the reflector having a curved surface for directing light from the lamp, the second spring means being positioned between the lamp socket and the reflector.

15. The flashlight of claim 13 wherein the conductive portion of the socket comprises a rear rim in abutment with the forward end of the casing.

16. The flashlight of claim 15 wherein the socket comprises a forward surface having a recess formed therein for receiving the second spring means.

17. The flashlight of claim 16 wherein said lamp socket includes an axially extending portion having a compartment formed therein for storing a spare lamp, and wherein said contact member comprises a conductive cap forming the rear of the compartment and contacting the battery.

18. The flashlight of claim 17 wherein the lamp and the spare lamp each comprise a bi-pin lamp, and wherein the lamp socket includes a rearward facing surface within the forward end of the compartment for receiving the pins of the spare lamp.

19. A flashlight having a forward end and a rear end, comprising:

a conductive casing adapted to enclose at least one battery, the casing being generally tubular with open ends, and having first engaging means formed in an interior surface thereof;

a resilient sleeve positioned on the casing, the sleeve having an open end for exposing the forward end of the casing, and a rear portion for enclosing the rear end of the casing;

a switch assembly positioned in the rear portion of the casing, the switch assembly having second engaging means for mating engagement with the first engaging means of the casing, the switch assembly being electrically connected with the casing and formed to provide a fluid passage between the switch assembly and the casing;

first spring means positioned within the casing between the battery and the switch assembly for urging the battery toward the forward end of the flashlight, the switch assembly having an actuating member extending toward the rear end of the casing, the actuating member being adapted to complete a circuit between the spring means and the casing;

a lamp;

a lamp socket for holding the lamp, the lamp socket having a conductive portion contacting the casing and a contact member contacting the forward end of at least one battery, the socket having means for connecting the lamp with the conductive portion and the contact member; and a head for the flashlight adapted to receive the lamp socket, the head being rotatably held by the forward end of the casing for changing the light pattern from flashlight.

20. The flashlight of claim 19 wherein said first engaging means in the interior surface of the casing includes a slot formed in the interior of the casing, and the second engaging means of the switch assembly includes at least one support member for engagement with the slot.

21. The flashlight of claim 19 wherein the conductive portion of the socket comprises a rim in abutment with the forward end of the casing.

22. The flashlight of claim 21 wherein the head comprises second spring means positioned therein for urging the rim against the forward end of the casing and for maintaining the rim in abutment with the forward end of the casing as the head is rotated.

23. A flashlight having a forward end and a rear end, comprising:

a conductive casing adapted to enclose at least one battery, the casing being generally tubular with open ends and having engagement means formed in an interior surface thereof;

an elastomeric sleeve positioned on the casing, the sleeve having an open end for exposing the forward end of the casing, and a rear portion for enclosing the rear end of the casing;

a switch assembly positioned in the rear portion of the casing, the switch assembly having engaging means for mating engagement with the engagement means of the casing and providing a fluid passage between the switch assembly and the casing, the switch assembly being adapted to complete a circuit between the battery and the casing at the rear end of the flashlight and including a rearwardly extending actuating member for completing the circuit between the battery and the casing;

a lamp;

a lamp socket for holding the lamp and for electrically connecting the lamp in a circuit between the casing and forward end of the battery; and a head for the flashlight at the forward end thereof adapted to receive the lamp socket, the head being rotatably received on the forward end of the casing.

* * * * *